US007156153B2

(12) United States Patent
Hohenbichler et al.

(10) Patent No.: US 7,156,153 B2
(45) Date of Patent: Jan. 2, 2007

(54) METHOD AND DEVICE FOR COMMENCING A CASTING PROCESS

(75) Inventors: Gerald Hohenbichler, Kronstorf (AT); Gerald Eckerstorfer, Linz (AT)

(73) Assignee: Voest-Alpine Industrieanlagenbau GmbH & Co. (DE)

( * ) Notice: Subject to any disclaimer, the term of this patent is extended or adjusted under 35 U.S.C. 154(b) by 67 days.

(21) Appl. No.: 10/527,533

(22) PCT Filed: Aug. 18, 2003

(86) PCT No.: PCT/EP03/09110

§ 371 (c)(1),
(2), (4) Date: Apr. 25, 2005

(87) PCT Pub. No.: WO2004/028725

PCT Pub. Date: Apr. 8, 2004

(65) Prior Publication Data

US 2005/0224210 A1 Oct. 13, 2005

(30) Foreign Application Priority Data

Sep. 12, 2002 (AT) ..... A 1367/2002

(51) Int. Cl.
*B22D 11/18* (2006.01)

(52) U.S. Cl. ..... 164/483; 164/480

(58) Field of Classification Search ..... 164/480, 164/483, 428

See application file for complete search history.

(56) References Cited

U.S. PATENT DOCUMENTS 4,719,960 A 1/1988 Grothe et al. ..... 164/426

4,787,437 A * 11/1988 Kursfeld ..... 164/453

FOREIGN PATENT DOCUMENTS

| | | |
|---|---|---|
| EP | 0138059 | 9/1984 |
| EP | 0208642 | 1/1987 |
| EP | 0867244 | 9/1998 |
| EP | 0903190 | 3/1999 |
| JP | 61266159 | 11/1986 |
| JP | 63290654 | 11/1988 |
| JP | 1133644 | 5/1989 |

(Continued)

OTHER PUBLICATIONS

International Search Report for PCT/EP03/09110 dated Nov. 18, 2003.

*Primary Examiner*—Len Tran
(74) *Attorney, Agent, or Firm*—Ostrolenik, Faber, Gerb & Soffen, LLP

(57) ABSTRACT

To start up a casting operation in a two-roll casting device without the use of a start-up strand, the method comprises setting an operating casting thickness and rotating the casting rolls at a casting-roll circumferential velocity which corresponds to a starting casting velocity, which is lower than a steady-state operating casting velocity, feeding metal melt into a melt space formed by the rotating casting rolls and the side plates to form a cast metal strip with a substantially constant, predetermined cross-sectional format while at the same time increasing the casting velocity to a strip-forming casting velocity, then increasing the casting velocity to a strip-separating casting velocity, which is significantly higher than a casting velocity which is sufficient for the prevailing full solidification conditions, and separating off the metal strip which has been cast thus far, setting a steady-state operating casting velocity, diverting the subsequent cast metal strip to a strip-conveying device and commencing steady-state casting operation.

23 Claims, 3 Drawing Sheets

FOREIGN PATENT DOCUMENTS

| | | |
|---|---|---|
| JP | 6114504 | 4/1994 |
| WO | 01/21342 | 3/2001 |

* cited by examiner $v_g$
$v_{gBetr}$
$v_{gTr}$
$v_{gBb}$
G
$v_{gst}$
$h_{gsp}$
$F_{Tr}$
t
t
G
F
h
0

METHOD AND DEVICE FOR COMMENCING A CASTING PROCESS

CROSS REFERENCE TO RELATED APPLICATION

The present application is a 35 U.S.C. §§ 371 national phase conversion of PCT/EP2003/009110 filed 18 Aug. 2003, which claims priority of Austrian Application No. A 1367/2002 filed 12 Sep. 2002. The PCT International Application was published in the German language.

BACKGROUND OF THE INVENTION

The invention relates to a method for starting a casting operation in a two-roll casting device without the use of a start-up strand, and to an apparatus for carrying out this method.

Chilled molds with a continuous mold cavity, in which the metal melt that is introduced on the entry side solidifies at least in the region of contact with the mold cavity walls, are mainly used for the production of a continuously cast metal strand of indeterminate length. A substantially fully solidified metal strand is taken out of the mold on the exit side. When starting the casting operation, the mold cavity first of all has to be filled with metal melt, and in particular, with a predominantly vertical orientation of the mold cavity, a starting piece which has been completely solidified has to be obtained so that the metal melt does not flow through the mold in uncontrolled fashion and escape from it. In this context, in particular the casting thickness of the metal strand that is to be produced, the solidification conditions and the quantity of heat that is to be dissipated through the mold cavity walls during the short residence time in the mold are of considerable importance.

To reliably avoid uncontrolled escape of metal melt from the mold during the starting phase of the casting process, it is customary to use a start-up strand to be introduced into the mold before casting commences, the start-up strand substantially but not necessarily completely closes up the exit cross section of the mold cavity and is only discharged from the mold by means of a pair of driving rolls once a solid join has been formed between the introduced melt and the start-up strand head and a pronounced strand shell of sufficient thickness along the mold cavity walls. This start-up operation requires at least one new start-up strand head to be coupled to the start-up strand each time the casting installation is restarted. A start-up strand of this type, as is used in the case of strip steel casting molds formed by wide side walls and narrow side walls, is known, for example, from U.S. Pat. No. 4,719,960.

A start-up strand specifically for use in a two-roll casting installation is described in EP-A 208 642. This start-up strand includes a start-up head with two flanges formed by thin strips of sheet metal which bear against the lateral surfaces of the casting rolls and thereby form a space for receiving the metal melt flowing in. The start-up strand and the strip which is initially cast are discharged from the casting nip formed by the casting rolls immediately after the first strand shell has been formed.

At very small casting thicknesses, preferably below a casting thickness of 5.0 mm, a start-up strand is not necessarily required, since the rapid solidification of the metal melt at the mold walls means that the open casting nip is bridged within a very short time. A number of start-up methods which do not require a start-up strand are likewise already known.

By way of example, JP-A 61 266 159 has disclosed a starting method in which the two interacting casting rolls, prior to the start of casting, are moved into a starting position in which there is no casting nip and the casting rolls are stationary. Immediately after the melt starts to be supplied and the first strand shell has formed on the two lateral surfaces of the casting rolls, the latter are moved apart to the operating casting nip (strip thickness), and the casting velocity is increased to the operating casting velocity along a run-up curve. However, a starting operation with stationary casting rolls is very unreliable, since the actual casting level in the melt space cannot be measured with the required accuracy all the way to the narrowest cross section between the casting rolls. Therefore, neither an increase in force between the two casting rolls nor the degree of filling of the mold can be suitably controlled. A different level of solidification of the melt along the strip width and in particular in the vicinity of the side plates can cause considerable wedge formation resulting from solidified metal above the narrowest cross section and can then lead to damage to the side plates. Furthermore, with a starting method with stationary casting rolls of this type, there is an increased risk of strand shell stickers forming on parts of the lateral surface of the casting rolls.

WO 01/21342 has disclosed an initial casting method for a two-roll casting device, in which before the supply of melt commences the casting nip between the two casting rolls is set to a value which is reduced compared to the operating casting nip. The melt is supplied with the casting rolls rotating, with the casting velocity being set in such a way that the thickness of the strip produced is greater than the casting nip that has previously been set. In principle, a reduced casting nip reduces the tendency of metal melt to drip through. On the other hand, small casting nips result to an increasing extent in the drawbacks which have been described above with regard to JP-A 61-266 159, in particular the probability of damage to the side plates.

Further initial casting methods for standard two-roll casting devices with special method stipulations for the casting velocity in the starting phase or the selection of a suitable starting casting thickness in relation to the operating casting thickness are already known from JP-A 63-290654, JP-A 1-133644 or JP-A-6-114504. EP-A 867 244 describes a control means by which in the starting phase of the casting process, in successive time periods, first of all the instantaneous velocity of the casting rolls is controlled as a function of a bath level measurement in the melt pool between the casting rolls, and then the supply of metal melt is controlled as a function of a roll velocity measurement.

Therefore, it is an object of the present invention to avoid the drawbacks of the prior art described in the introduction and to propose a method for starting a casting operation in a two-roll casting device and a device for carrying out the method, in which it is possible to keep the passage of metal melt through the casting nip at a low level and at the same time the likelihood of wedges and thickened portions forming at the start of the cast strip is as far as possible avoided. At the same time, it is intended for a first piece of the cast strip, which does not meet the quality demands imposed for continuous production, to be separated from the strip which is produced subsequently under substantially steady-state operating conditions without mechanical separating devices being required for this purpose.

SUMMARY OF THE INVENTION

The method according to the invention achieves this object by means of the following steps:

setting an operating casting thickness and rotating the casting rolls at a casting-roll circumferential velocity which corresponds to a starting casting velocity, which is lower than a steady-state operating casting velocity, feeding metal melt into a melt space, which is formed by the rotating casting rolls and the side plates bearing against them, and forming a cast metal strip with a substantially constant, predetermined cross-sectional format while at the same time increasing the casting velocity to a strip-forming casting velocity, then increasing the casting velocity to a strip-separating casting velocity, which is significantly higher than a casting velocity which is sufficient for the prevailing full solidification conditions, and separating off the metal strip which has been cast thus far, setting a steady-state operating casting velocity, diverting the subsequent cast metal strip to a strip-conveying device and commencing steady-state casting operation.

The casting velocity is always determined by the casting roll circumferential velocity, since the strand shells which are formed at and adhere to the casting roll lateral surfaces are conveyed through the narrowest cross section between the casting rolls and joined to one another at this velocity.

The starting casting velocity is a low casting velocity at which, on account of the extended residence time of the strand shells which form in the melt space, increased strand shell growth occurs, and therefore the casting nip which is open in the downward direction can be bridged particularly quickly.

The strip-forming casting velocity is a casting velocity which is dependent in particular on the current liquid metal mold level and also on the solidification conditions and the casting roll separating force required on the basis of the steel analysis, at which strip formation and removal of the strip formed in the downward direction take place and at which substantially constant strip-forming conditions can be maintained. During the transition from the starting casting velocity to the strip-forming casting velocity, the melt space is continuously filled with metal melt up to the operating mold level, with the strip-forming casting velocity increasing continuously as the mold level rises.

Since in the claimed method the casting nip is kept at the value of the operating casting thickness throughout the entire starting operation, additional advantages result: a reduced starting casting velocity results in a low throughput of strip until the desired operating mold level is fully reached, and in this way the scrap is kept at a low level. Furthermore, the fact that the operating casting thickness is not reduced in the starting phase results in fewer faults which, on account of solidification at the narrow side walls, lead to widening of the casting nip during passage through the casting cross section and possibly to uncontrolled cracking of the cast strand. The absence of radial displacement of the casting rolls, which inevitably occurs if the starting operation is commenced at a starting casting thickness that is reduced compared to the operating casting thickness, also reduces the parasitic solidifications which would form at the relatively cold, uncovered zones at the side plates.

To achieve sufficiently rapid strand shell growth at the lateral surfaces of the casting rolls and therefore to rapidly bridge the casting nip by solidified metal melt, the starting casting velocity is selected to be lower than half the operating casting velocity, with the casting rolls usually rotating. At casting thicknesses above 3 mm, the starting phase can also be initiated with stationary casting rolls, and consequently the starting casting velocity is still 0 m/min when metal melt starts to be supplied, and the casting rolls are then accelerated rapidly.

Particularly expedient conditions for rapidly bridging the casting nip by means of solidified metal melt in the starting phase result if the starting casting velocity is less than 12 m/min. A starting casting velocity in this range allows good matching in terms of time between the supply of melt until the operating casting level is reached and the running-up of the starting casting velocity to a strip-forming casting velocity, which approximately corresponds to the operating casting velocity. This is achieved by a moderate, continuous increase in the casting-roll circumferential velocity to a strip-forming casting velocity, which matches a measurable desired mold level, in order to ensure reliable strip formation (strand shell formation on the casting roll surfaces in the melt pool). Accordingly, the strip-forming casting velocity is set or controlled in accordance with a measurable desired mold level.

A further option for optimum setting of the strip-forming casting velocity consists in the strip-forming casting velocity being controlled as a function of the separating force which occurs between the casting rolls. For a predetermined casting nip, the separating force which acts between the two casting rolls is a measure of the strand shell thickness and the current solidification state in the narrowest cross section between the casting rolls. The further the solidification process has progressed in this region, the higher the separating force becomes. The metal bath level, which is predominantly rising continuously in the starting phase and has a considerable influence on the strand shell formation, is hereby taken into account.

The measured values from a bath level measurement and a separating force measurement can also be used in combination to control the strip-forming casting velocity.

The term strip-separating casting velocity is to be understood as meaning the casting velocity at which the first part of the cast metal strip, which has been produced under non-steady-state casting conditions in the starting phase of the casting process and is therefore to be regarded as scrap material, is separated from the metal strip which continuously follows it and has been produced under substantially steady-state casting conditions. According to one possible embodiment, this separation takes place exclusively under the action of the dead weight of the starting piece of the cast metal strip which hangs downward as it leaves the narrowest cross section between the casting rolls, as a result of this starting piece being torn off in the casting nip. Increasing the casting velocity to the strip-separating casting velocity alters the solidification conditions and therefore the mechanical properties of the cast strip in the casting cross section, specifically by reducing the tensile strength, in such a way that the strip tears off in this cross section without the need for additional mechanical measures.

Alternatively, the separation of the cast metal strip at the strip-separating casting velocity can take place under the action of a strip tension which is increased compared to the force of gravity and is applied by a driver arrangement which is arranged on the exit side beneath the casting nip of the two-roll casting device.

The separation conditions can be improved if a brief increase in the casting thickness by 5 to 40% is superimposed on the increase in the casting velocity to the strip-separating casting velocity.

The strip-separating casting velocity is higher than the operating casting velocity, and is preferably 5% to 40% higher than the operating casting velocity.

This strip-separating casting velocity is briefly set as soon as approximately steady-state casting conditions are reached. It is preferable for a constant strip quality also already to have been ensured. It is expedient for the strip-separating casting velocity to be set in the starting phase when the metal melt in the melt space has substantially reached the desired operating mold level.

To ensure a continuous transition to steady-state casting conditions and therefore to steady-state solidification conditions at the casting rolls and in the casting nip, it is expedient if the casting velocity is increased to approximately the operating casting velocity before the desired operating mold level is reached in the melt space.

The proposed method makes it possible for steady-state casting operation to be reached within 5 to 60 sec of the supply of metal melt to the melt space commencing.

In particular in the case of very thin strips, it is advantageous if when starting a casting operation, a starting casting thickness which is greater than the operating casting thickness is set, and this starting casting thickness is reduced to the operating casting thickness at the earliest after a cast metal strip with a substantially constant cross-sectional format has been formed. This method is preferably employed at casting thicknesses of less than 2.5 mm, since the difficulties described in the introduction relating to side plate solidification and the formation of wedges and subsequent uncontrolled strip cracks may arise in particular in this thickness range, and consequently the strip which follows the strip separation has an improved inherent strength allowing it to be guided through the installation.

To ensure an automated sequence of the starting method, it is expedient if at least reference data relating to the instantaneous casting velocity and the instantaneous mold level of the metal melt in the melt space and/or the instantaneous separating force between the casting rolls and/or the nip width between the casting rolls and/or the strip thickness of the cast metal strip are determined continuously while casting is starting up and are fed to a calculation unit, and on the basis of a mathematical model for the starting operation, these reference data are used to generate control variables for the casting velocity, for the position of a strip-guiding device and for the conveying velocity of the cast metal strip in a strip-conveying device and to transmit these control variables to the drive units of these devices.

In addition, the separation conditions for separating off the first piece of the cast metal strip in the casting cross section are improved if a control variable for positioning the distance between the two casting rolls, in particular an increased starting casting thickness, is generated from the mathematical model on the basis of current input data, such as steel quality, operating casting thickness, temperature conditions, quality-related solidification conditions, etc.

The quality of the metal strip produced can be generally optimized on an ongoing basis during the casting process and adapted to changing operating conditions if the mathematical model comprises a metallurgical model relating to the formation of a defined microstructure in the cast metal strip and/or to the influencing of the geometry of the cast metal strip.

A two-roll casting device for carrying out the described method for starting a casting operation without a start-up strand comprises two casting rolls which are coupled to rotary drives and rotate in opposite directions, and side plates, which bear against the casting rolls and together form a melt space for receiving the metal melt, as well as at least one displaceable strip-guiding device and at least one strip-conveying device. This two-roll casting device is characterized in that the casting rolls are assigned a velocity-measuring device for determining the instantaneous casting velocity, in that the melt space is assigned a level-measuring device for determining the instantaneous mold level of the metal melt, in that the velocity-measuring device and the level-measuring device are connected to a calculation unit by signal lines, and the calculation unit is connected by signal lines to the rotary drive of the casting rolls, to a position-adjusting device of the strip-guiding device and to the drive of a strip-conveying device. The two casting rolls can also be coupled to a common rotary drive with a distributor transmission connected in between.

A two-roll casting device equipped in this way allows current production data from the steelmaking process to be incorporated and processed together with measurement data from the casting device in a calculation model for optimizing the starting method.

An expedient sequence of the method according to the invention is also possible if, instead of the continuous measurement of the mold level in the melt space by means of a level-measuring device, a separating-force measuring device for determining the instantaneous separating force, which is substantially caused by the strip formation, between the two casting rolls or a position-measuring device for determining the instantaneous nip width between the casting rolls or a measuring device for determining the instantaneous strip thickness is alternatively used. Each of these measurements delivers reference data which at least indirectly produce a relationship which can be described in mathematical terms with the strand shell formation in the melt pool and therefore with the metal strand formation in the narrowest cross section between the casting rolls and which can therefore be used in a mathematical model to calculate control variables in order for the starting operation to be carried out within the shortest possible time and/or in a manner which is optimized with regard to shape and guidance of the strip detachment edge. A further improvement to the starting method can be achieved by combining at least two of these measurement methods, with the measurements being carried out at the same time and being processed in a correspondingly expanded mathematical model.

A further optimization to the method results if at least one of the two casting rolls is coupled to a casting-roll adjustment device and the calculation unit is additionally connected by a signal line to a casting-roll adjustment device for setting a starting casting thickness. As a result, a specific, higher starting casting thickness can be determined for predetermined production characteristic variables, such as in particular the steel quality, the casting format, preferably the operating casting thickness, and characteristic data taken from the steel production, such as for example the superheating temperature of the melt, and from measurement data at the installation in the process model and this thickness can then be set at the casting installation.

The present method and the associated two-roll casting installation are suitable for the casting of metal melts, preferably Fe-containing metal alloys, in particular for steels.

BRIEF DESCRIPTION OF THE DRAWINGS

Further advantages and features of the invention will emerge from the following description of non-limiting exemplary embodiments, in which reference is made to the appended figures, in which.

DESCRIPTION OF PREFERRED EMBODIMENT

Figure 1:
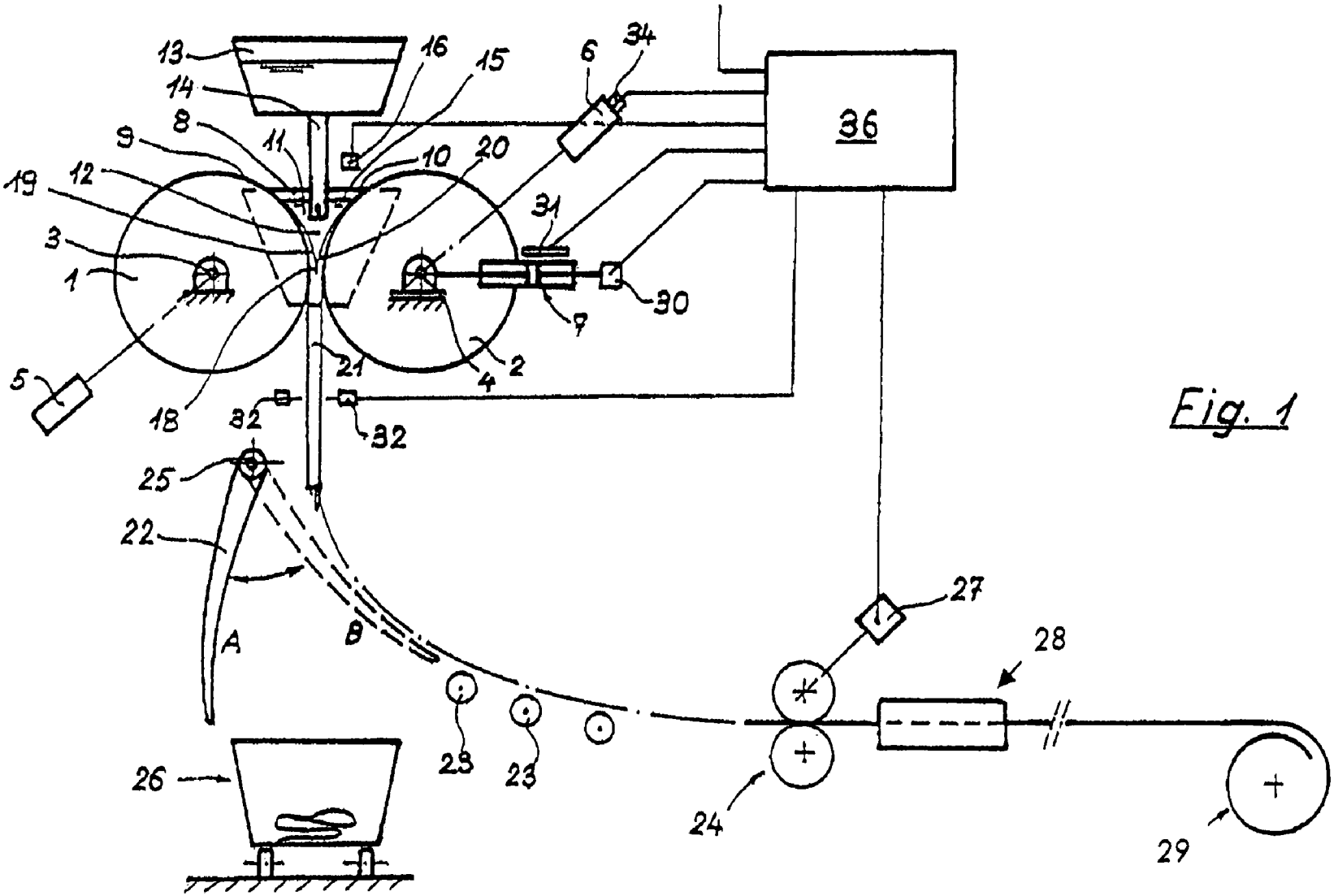
FIG. 1 diagrammatically depicts a two-roll casting device for carrying out the method according to the invention, FIG. 2*a* diagrammatically depicts the solidification conditions in the casting nip at the operating casting velocity, FIG. 2*b* diagrammatically depicts the solidification conditions in the casting nip at the strip-separating casting velocity.

A two-roll casting installation having the devices required to carry out the method according to the invention is diagrammatically depicted in FIG. 1. It comprises two casting rolls 1, 2 which are arranged at a distance from one another in a horizontal plane and are equipped with internal cooling (not shown). These casting rolls 1, 2 are supported rotatably in shaft bearings 3, 4 and are coupled to rotary drives 5, 6, which allow the casting rolls 1, 2 to be rotated in opposite directions about casting-roll axes 1', 2' at a controllable circumferential velocity which corresponds to the casting velocity. To determine the instantaneous casting velocity, at least one of the casting rolls 1, 2 or the associated rotary drives 5, 6 or also the cast metal strip itself is assigned a velocity-measuring device 34. One of the two casting rolls 2 is supported such that it can be displaced in the horizontal plane transversely with respect to the casting roll axis 2' and is coupled to a casting-roll adjustment device 7, so that the distance between the two casting rolls 1, 2 can be set in a controllable way. Side plates 8 are disposed such that they can be pressed onto the end sides of the casting rolls 1, 2, these side plates 8, together with a portion of the lateral surfaces 9, 10 of the rotating casting rolls, forming a melt space 11 for receiving metal melt 12. The metal melt 12 is introduced continuously in a controlled way into the melt space 11 from a tundish 13 through an immersion pipe 14, so that during steady-state casting operation the supply of melt through the immersion pipe outlets is in submerged form, i.e. is always below a mold level 15 which is kept constant. A level-measuring device 16 arranged above the melt space 11 continuously monitors the mold level.

On the exit side, the melt space 11 is delimited by a casting nip 18, which is defined by the distance between the two casting rolls 1, 2 and determines the casting thickness D of the cast metal strip. The solidified strand shells 19, 20 which have formed at the lateral surfaces 9, 10 of the casting rolls in the melt space 11 are joined in the casting nip 18 to form a substantially fully solidified metal strip 21 which is conveyed downward out of the casting nip 18 as a result of the rotary motion of the casting rolls 1, 2, is diverted into a substantially horizontal conveying direction by a downstream, pivotable strip-guiding device 22 and strip-guiding rolls 23 and conveyed out of the two-roll casting device to a strip-conveying device 24 formed by a pair of driving rolls. The strip-guiding device 22, which is of arcuate design, is connected to a drive unit 25 which enables the strip-guiding device 22 to be pivoted from a set-back position A into an operating position B and back. During the starting operation of the casting process, the strip-guiding device is in the set-back position A, and after a first piece of the cast metal strip has been separated off is pivoted into the operating position B, where it can remain throughout the whole of the steady-state production process. A scrap collecting trolley 26 is arranged vertically beneath the casting nip 18, and any metal melt which drips through at least at the outset and also the first portion of the cast strip are collected in the trolley and can then be transported away when necessary.

The scrap collecting trolley may also be designed without wheels. It may be positioned within a chamber boundary wall which encloses the path of the cast metal strip from the casting rolls to the first driver. Also, this first portion of the cast strip does not necessarily have to drop directly into the scrap collecting trolley, but rather can also be fed to the latter indirectly.

After the cast metal strip emerges from the strip-conveying device 24, which is equipped with a drive unit 27, it is treated in further treatment devices 28 (not illustrated in more detail) and finally wound into coils 29 and/or divided into plates. The further treatment devices 28 may, for example, be formed by rolling stands, trimming devices, surface treatment devices, a wide range of heat treatment devices, such as heating devices, holding furnaces, temperature balancing furnaces, and cooling sections.

The two-roll casting device is equipped with a calculation unit 36 which enables the starting operation to be carried out automatically as a function of predetermined input variables and current measurement variables determined at the device. The calculation unit uses characteristic data diagrams and/or a mathematical model to generate optimum control variables, such as the starting casting velocity $V_{gSt}$, the position of the strip-guiding device, the driving velocity of the strip-conveying device and if appropriate the starting casting thickness $D_{St}$ and further control variables, in order thereby to continuously control and monitor the starting operation.

Control variables which are generated in order to carry out the starting method from the calculation unit 36 are based on up-to-date measurement data acquired from the casting installation, which are directly or indirectly related to the strand shell growth. The instantaneous mold level 15, i.e. the height of the melt pool in the melt space 11, which can be determined continuously using a level-measuring device 16, is predestined for this purpose. The separating force $F_{Tr}$ between the two casting rolls 1, 2 represents a reaction force to the strand shells passed through and likewise provides a reference value for the degree of solidification in the narrowest cross section between the casting rolls. It can be determined using a separating-force measuring device 30 which is assigned to the casting-roll bearing arrangements 3, 4 or is installed in the casting-roll adjustment device 7. A further option for determining a reference variable is the instantaneous nip width G between the casting rolls, which is closely related to the separating force $F_{Tr}$, since a higher separating force effects increased radial yielding of the casting rolls 1, 2 away from one another and/or deformation thereof. This can be measured directly by a position-measuring device 31 at the casting rolls or indirectly via a strip thickness measuring device 32. The simultaneous measurement and processing of the measurement data from a plurality of the measurement systems described minimizes the time required to start up the installation and in particular increases the quality of the strip detachment edge of the subsequent metal strip in terms of its geometry and its guidance through the installation, and also the quality of the product produced right from the start of production.

Figure 2A:
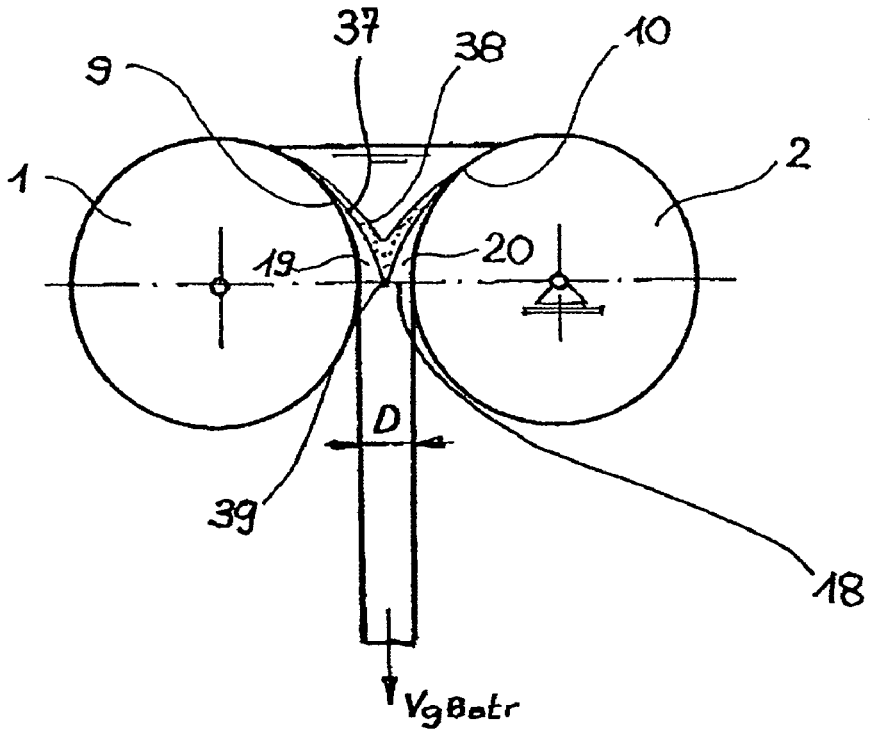
Figure 2B:
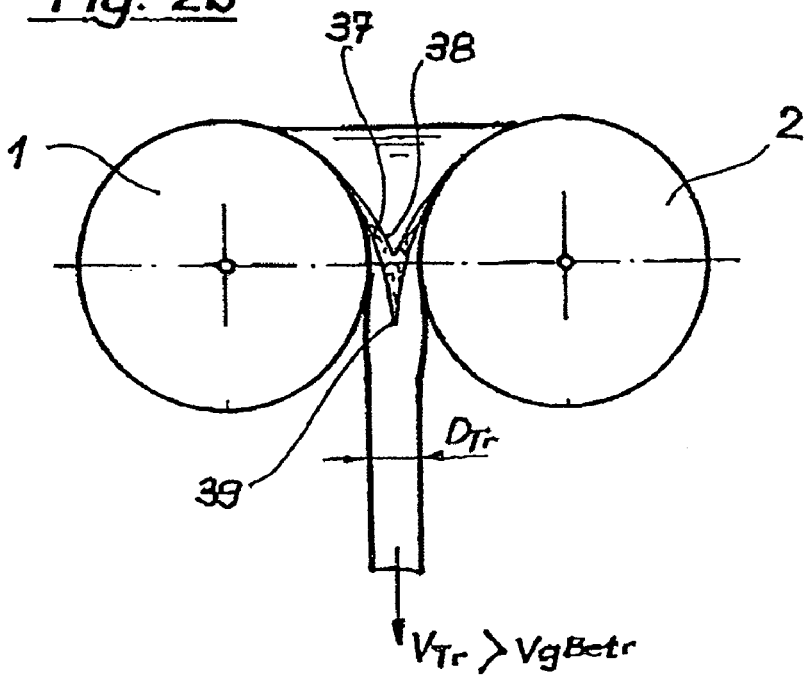

The solidification conditions at the lateral surfaces 9, 10 of the two casting rolls and in the casting nip 18 at a steady-state operating casting velocity and at the strip-separating casting velocity are compared in FIGS. 2*a* and 2*b*. At the steady-state operating casting velocity (FIG. 2*a*), the two casting rolls 1, 2 are set to a casting nip 18 which in particular corresponds to the steady-state mold level and the operating casting thickness D of the desired cast metal strip. In this case, a strand shell 19, 20 which becomes increasingly thick in the direction of rotation of the casting rolls, i.e. toward the casting nip 18, is formed at each of the lateral surfaces 9, 10 of the casting rolls. The two strand shells 19, 20 are joined together in the casting cross section 18, and under steady-state casting conditions a fully solidified metal strip is formed. The V-shaped lines 37 in this case illustrate the transition from 100% melt to a mixed region with an increasing solid-state component, and the V-shaped line 38 illustrates the transition to a 100% solid state, i.e. the fully solidified strand part. FIG. 2*b* shows the altered solidification conditions at a strip-separating casting velocity, which is higher than the operating casting velocity. This means that the circumferential velocity of the casting rolls is increased. The cooling conditions were not changed. As a result, the time which is available for the strand shells to form in the melt space and therefore the strand shell growth are reduced, so that the full solidification point 39 is shifted in the casting direction, and either an increased proportion of the liquid state is still present in the casting cross section and/or the mean strip temperature is at least higher than at the operating casting velocity. In both cases, the tensile strength of the metal strip piece which hangs downward is reduced at the strip-separating casting velocity to such an extent that the metal strip tears off in the casting cross section under its own weight.

In one preferred embodiment, the casting velocity is increased to such a high strip-separating casting velocity and then immediately reduced again that temporarily no separating force is measured. During this short phase, the fact that the two strand shells are not joined means that metal melt, under the action of the ferrostatic pressure, flows down into the space below the narrowest cross section between the casting rolls. This leads to local bulging of the metal strip and considerable reheating of the strip layers close to the surface, resulting in the strip tearing off under the influence of its own weight which is hanging down.

Figure 3:
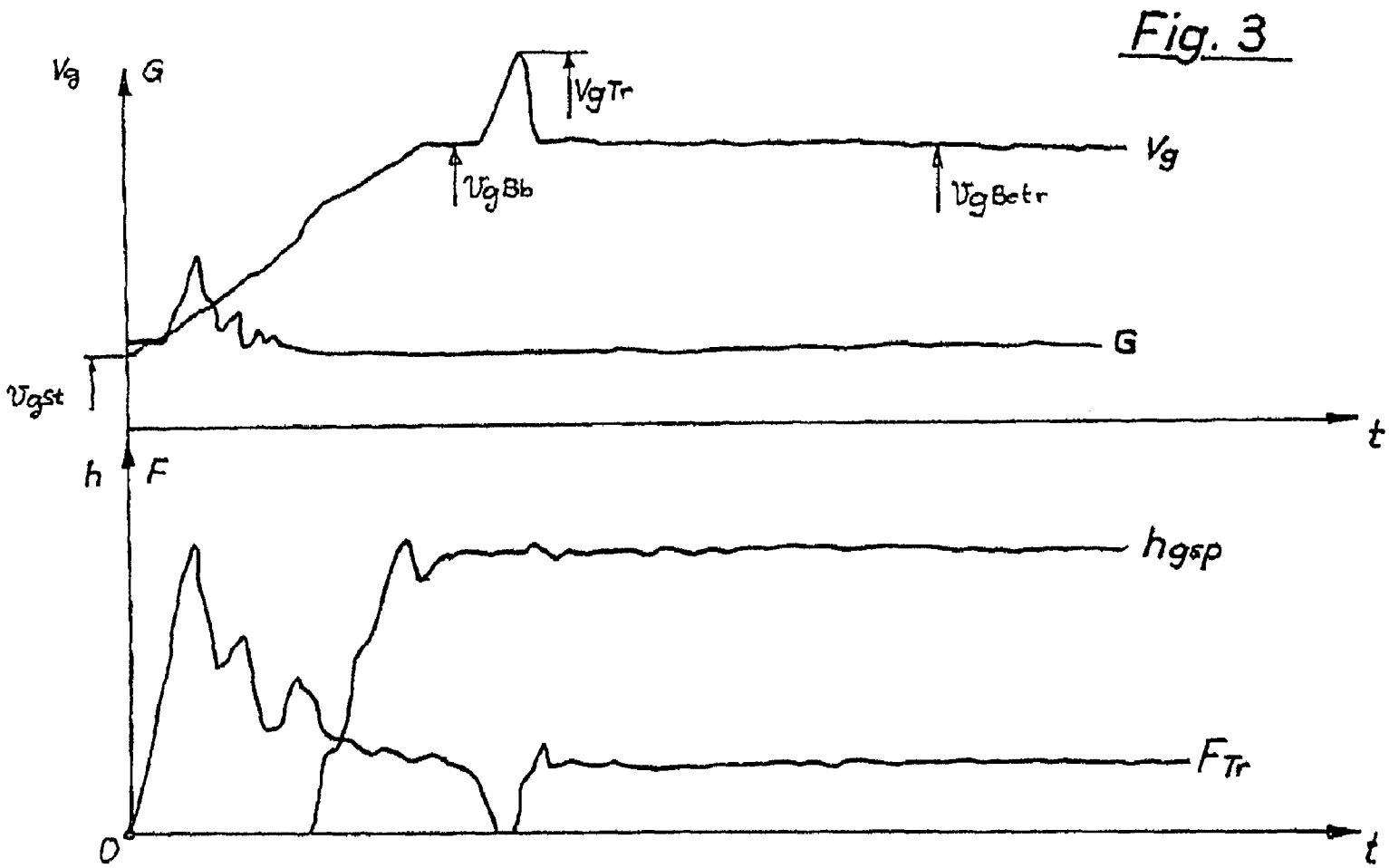
FIG. 3 shows curves illustrating the casting velocity, the casting nip width, the mold level signal and the casting roll separating force when starting a casting operation for a steel grade AISI 304.

FIG. 3 shows the sequence of the method described for starting a casting operation in a two-roll casting installation for a stainless Cr—Ni steel grade AISI 304 with a steady-state operating casting thickness D=2.5 mm and an operating casting velocity $V_{gBetr}$=60 m/min. Before the melt is supplied, the operating casting nip of 2.5 mm is set and the casting rolls are driven at a circumferential velocity which corresponds to a starting casting velocity $V_{gSt}$=10 m/min. When the supply of melt commences, the casting velocity $V_g$ is continuously increased up to the strip-forming casting velocity $V_{gBb}$, which approximately corresponds to the operating casting velocity $V_{gBetr}$=60 m/min. Just shortly after the supply of melt has commenced, the downwardly open casting nip is bridged by the strand shells which are formed, even while the casting velocity is still very low. This manifests itself by the brief, sudden rise in the curve for the casting nip position G and the casting roll separating force $F_{Tr}$, which are directly correlated. The casting nip position G is measured at the hydraulic piston of an AGC system. As the casting velocity $V_g$ increases, the tendency for the separating force to rise is reversed again, since the strand shell formation also decreases on account of the shorter residence time of the strand shell in the melt space. The mold level $h_{Gsp}$ can only be measured after a defined filling level has been reached, since the melt space narrows in a funnel shape toward the casting cross section on account of the arrangement of the casting rolls, and level measurement in this very narrow region is not technically feasible. The operating mold level $h_{Betr}$ is reached after a period of approximately 5 to 15 sec, which can be selected variably, and is then kept constant. This results in approximately constant casting conditions, and the casting velocity is increased for a brief time of 0.2 sec to the strip-separating casting velocity $v_{gTr}$=80 m/min., which is 20 m/min. higher than the steady-state operating casting velocity $V_{gBetr}$. At this strip-separating casting velocity, the cast metal strip tears off in the narrowest cross section between the casting rolls under the influence of its own weight. As it does so, the casting-roll separating force $F_{Tr}$ briefly drops to zero. As the casting velocity returns to the value of the operating casting velocity $V_{gBetr}$=60 m/min., the casting-roll separating force $F_{Tr}$ immediately rises back to the value before the casting velocity was increased to the strip-separating casting velocity. This results in the conditions required for steady-state casting operation and ensures the production of a steel strip of constant quality.

The invention claimed is:

1. A method for starting a casting operation in a two-roll casting device without start-up strand, comprising the following steps:

setting an operating casting thickness (D);

rotating the casting rolls at a casting-roll circumferential velocity which corresponds to a starting casting velocity ($V_{gSt}$) and which is lower than a steady-state operating casting velocity ($V_{gBetr}$);

feeding metal melt into a melt space, which is formed by the rotating casting rolls and the side plates bearing against them, and forming a cast metal strip with a substantially constant, predetermined cross-sectional format while at the same time increasing the casting velocity ($V_g$) to a strip-forming casting velocity ($V_{gBd}$);

then increasing the casting velocity ($V_g$) to a strip-separating casting velocity ($V_{gTr}$), which is significantly higher than a casting velocity ($V_g$) which is sufficient for prevailing full solidification conditions, and separating off the metal strip which has been cast thus far;

setting the steady-state operating casting velocity ($V_{gBetr}$); and commencing steady-state casting operation.

2. The method as claimed in claim 1, wherein the starting casting velocity ($V_{gSt}$) is lower than half the operating casting velocity ($V_{gBetr}$).

3. The method as claimed in claim 1, wherein the starting casting velocity ($V_{gSt}$) is less than approximately 12 m/min.

4. The method as claimed in claim 1, wherein the starting casting velocity ($V_{gSt}$) is at 0 m/min when metal melt starts to be fed and is then accelerated.

5. The method as claimed in claim 1, further comprising setting the strip-forming casting velocity ($V_{gBb}$) to correspond to a measurable desired mold level ($h_{Gsp}$).

6. The method as claimed in claim 1, wherein the strip-forming casting velocity ($V_{gBb}$) substantially corresponds to the steady-state operating casting velocity ($V_{gBetr}$).

7. The method as claimed in claim 1, further comprising regulating the strip-forming casting velocity ($V_{gBb}$) as a function of a separating force ($F_{Tr}$) which occurs between the casting rolls.

8. The method as claimed in claim 1, wherein the strip-separating casting velocity ($V_{gTr}$) is higher than at least one of the strip-forming casting velocity ($V_{gBb}$) and the operating casting velocity $V_{gBetr}$).

9. The method as claimed in claim 8, wherein the strip-separating casting velocity ($_{VgTr}$) is 5% to 40% higher than at least one of the strip-forming casting velocity ($V_{gBb}$) and the operating casting velocity ($V_{gBetr}$).

10. The method as claimed in claim 1, further comprising superimposing a brief increase in the casting thickness (D) by 5 to 40% onto the increase in the casting velocity to the strip-separating casting velocity ($V_{gTr}$).

11. The method as claimed in claim 1, further comprising setting the strip-separating casting velocity ($_{VgTr}$) as soon as the metal melt in the melt space has substantially reached a desired operating mold level ($h_{Gsp}$).

12. The method as claimed in claim 1, further comprising separating the cast metal strip off at the strip-separating casting velocity ($_{VgTr}$) by causing the cast strip to be torn off under the action of the metal strip's own weight in the casting nip between the casting rolls.

13. The method as claimed in claim 1, further comprising separating the cast metal strip off at the strip-separating casting velocity ($V_{gTr}$) under the action of increased strip tension.

14. The method as claimed in claim 1, further comprising increasing the casting velocity ($V_g$) to approximately the operating casting velocity ($V_{gBetr}$) at least during a period before a desired operating mold level ($h_{gsp}$) is reached in the melt space.

15. The method as claimed in claim 1, wherein the steady-state casting operation is reached within 5 to 60 sec of the metal melt first being fed into the melt space.

16. The method as claimed in claim 1, further comprising when starting a casting operation for the production of a very thin metal strip, setting a starting casting thickness ($D_{St}$) which is greater than the operating casting thickness (D), and reducing the starting casting thickness is reduced to the operating casting thickness (D) at the earliest after a cast metal strip with a substantially constant, predetermined cross-sectional format has been formed.

17. The method as claimed in claim 1, further comprising determining continuously at least one of reference data relating to a) the instantaneous casting velocity ($V_g$) and the instantaneous mold level of the metal melt, b) the instantaneous separating force ($F_{Tr}$) between the casting rolls and the nip width (G) between the casting rolls and c) the strip thickness of the cast metal strip while casting is starting up and feeding the feeding the reference data of at least one of a), b) and c) to a calculation unit (36);

based on a mathematical model for the starting operation, using the reference data to generate control variables for the casting velocity, for the position of a strip-guiding device and for the conveying velocity of the cast metal strip in a strip-conveying device and transmitting these control variables to drive units of the strip conveying devices.

18. The method as claimed in claim claim 17, further comprising generating a control variable for the spacing positioning of the casting rolls with respect to one another, from the mathematical model.

19. The method as claimed in claim claim 17, wherein the mathematical model comprises a metallurgical model relating to at least one of formation of a defined microstructure in the cast metal strip and influencing of the geometry of the cast metal strip.

20. A two-roll casting device for carrying out a method for starting a casting operation of a metal strip without a start-up strand comprising two casting rolls, rotary drives coupled to the casting rolls to rotate the rolls in opposite directions;

side plates, which bear against the casting rolls and together form a melt space for receiving metal melt; at least one displaceable metal strip-guiding device and at least one metal strip-conveying device;

a velocity-measuring device for the casting rolls for determining an instantaneous casting velocity ($V_g$);

at least one of a) a level-measuring device for the melt space for determining the instantaneous mold level ($h_{gsp}$) of the metal melt, b) a separating-force measuring device for one of the casting rolls for determining the instantaneous separating force ($F_{Tr}$) between the two casting rolls, c) a position measuring device for the casting rolls for determining the instantaneous nip width (G) between the casting rolls, and d) a strip thickness-measuring device arranged on the strip exit side of the casting rolls for determining the instantaneous strip thickness (D) of the metal strip leaving the casting rolls a calculation unit connected by signal lines to the velocity-measuring device and the level-measuring device and at least one of d) the separating-force measuring device, e) the position-measuring device and f) the strip thickness-measuring device, signal lines connecting the calculation unit to the rotary drives of the casting rolls, to a position-control device of the strip-guiding device and to the drive of strip-conveying device.

21. The apparatus as claimed in claim 20, further comprising a casting-roll adjustment device coupled to at least one of the two casting rolls, and the calculation unit is additionally connected by a signal line to the casting-roll adjustment device to set a starting casting thickness ($D_{St}$) which is higher than an operating casting thickness (D).

22. The method as claimed in claim 1, further comprising prior to commencing steady-state casting, diverting the cast metal strip to a strip-conveying device.

23. The method of claim 18, wherein the control variable generated is a starting casting thickness ($_{Dst}$).

* * * * *